US008257122B1

(12) United States Patent
Holley

(10) Patent No.: US 8,257,122 B1
(45) Date of Patent: Sep. 4, 2012

(54) TROLLING MOTOR DIRECTION CONTROL ASSEMBLY AND THROTTLE HANDLE

(75) Inventor: Steven E. Holley, Cushing, OK (US)

(73) Assignee: Brunswick Corporation, Lake Forest, IL (US)

( * ) Notice: Subject to any disclaimer, the term of this patent is extended or adjusted under 35 U.S.C. 154(b) by 524 days.

(21) Appl. No.: 12/474,649

(22) Filed: May 29, 2009

(51) Int. Cl.
*B63H 21/21* (2006.01)

(52) U.S. Cl. ..... 440/87

(58) Field of Classification Search ..... 440/84–87, 440/63, 6; 123/400; 74/491, 501.6, 502, 74/503, 504
See application file for complete search history.

(56) References Cited

U.S. PATENT DOCUMENTS 4,518,362 A * 5/1985 Johnson et al. ..... 440/6
4,582,493 A * 4/1986 Toyohara et al. ..... 440/84
5,340,342 A * 8/1994 Boda et al. ..... 440/86
5,453,030 A * 9/1995 Broussard ..... 440/6
7,331,834 B2 * 2/2008 Yasuda et al. ..... 440/87
7,666,038 B2 * 2/2010 Yomo et al. ..... 440/53

* cited by examiner

*Primary Examiner* — Stephen Avila
*Assistant Examiner* — Andrew Polay
(74) *Attorney, Agent, or Firm* — Andrus, Sceales, Starke & Sawall, LLP

(57) ABSTRACT

The present application includes a multi-function throttle shaft that combines the motor speed-control and the motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

17 Claims, 6 Drawing Sheets

TROLLING MOTOR DIRECTION CONTROL ASSEMBLY AND THROTTLE HANDLE

FIELD

The present application is directed to the field of trolling motors. More specifically, the present application is directed to the field of direction control design in trolling motors.

BACKGROUND

Presently, there are currently three known ways to reverse direction with a tiller-steer trolling motor. First, the operator can rotate the tiller handle 180°. This procedure places the tiller handle out of the boat and over the water, requiring the operator to leave their seat and assume an awkward and risky position for fishing, back-trolling, docking, etc. Second, some trolling motors provide a switch for electrically reversing the trolling motor direction. These switches are located separate from the tiller handle and require attention to locate, and the use of a second hand to operate or move the tiller steering hand from the tiller handle to the toggle switch and back and forth. Third, most variable speed trolling motors have forward and reverse from a center "Off" position. Clockwise rotation of the throttle handle is normally for forward motion and counterclockwise rotation of the throttle handle is for the reverse direction. With opposite rotational directions for travel direction, it is impossible to change direction instantly and the relationship of motion to rotation is not intuitive but is common.

SUMMARY

The present application includes a multi-function throttle shaft that combines the motor speed-control and the motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

DETAILED DESCRIPTION

The assembly and throttle handle of the present application includes a multi-function throttle handle for a tiller type trolling motor which includes a throttle-off position, variable throttle control, direction control, and a direction-gate that prevents reversing direction above speeds too fast for safety. To support very rapid direction change for boat maneuverability, the controller electronics manages motor surge currents that would otherwise damage the power reversing relays or otherwise require them to be very large and expensive by timing the switching such that zero motor current is flowing in the relay contacts at the instant of reversal. Providing a throttle handle axial movement that corresponds to the desired boat direction and a co-functional rotational movement for speed creates an intuitive control system for unique and maximum boat maneuverability.

Figure 1:
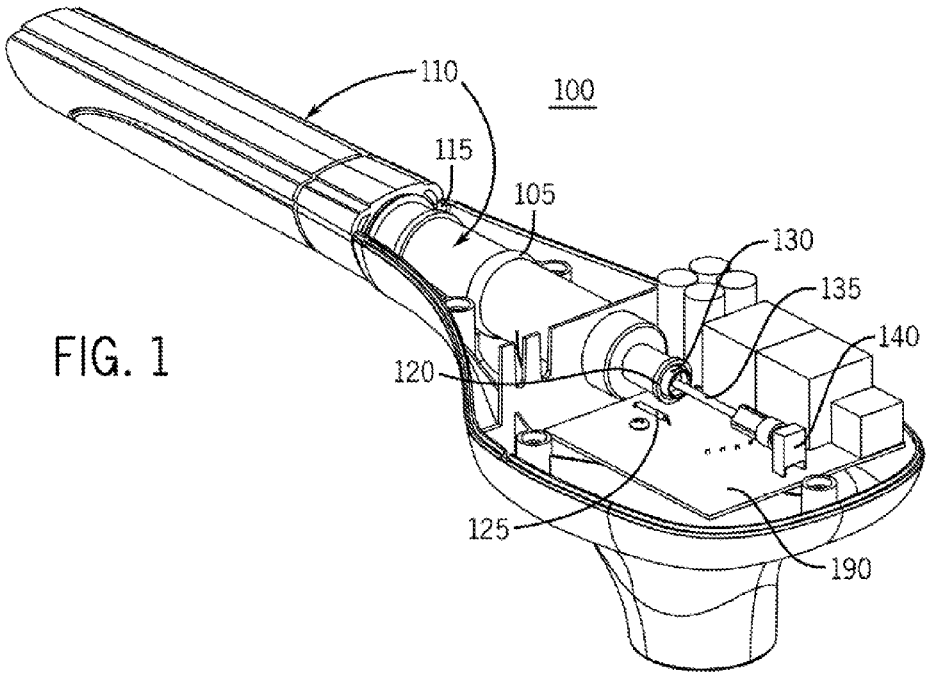
FIG. 1 is an elevation view illustrating a controller head assembly with top cover removed according to an embodiment of the present application.

FIG. 1 is an overview of the controller head assembly 100 with the top cover removed. The throttle handle 110 rotates the speed transducer 140 on the controller board 190 through a slip joint 130 and flexible coupling 135. The slip joint 130 allows the throttle handle 110 to be pushed in and pulled out of the assembly 100 the distance necessary for operating a direction sensor 120, 125 while continuing to engage the flexible coupling 135 that connects the handle 110 to the speed transducer 140. The rotational position of the speed transducer 140 is not altered by the axial in and out movement of the throttle handle 110. The slip joint 130, as shown in more detail in FIGS. 5 and 6, engages the flexible coupling 135 without rotational slippage at any axial position of the throttle shaft during in and out movements.

Figure 2:
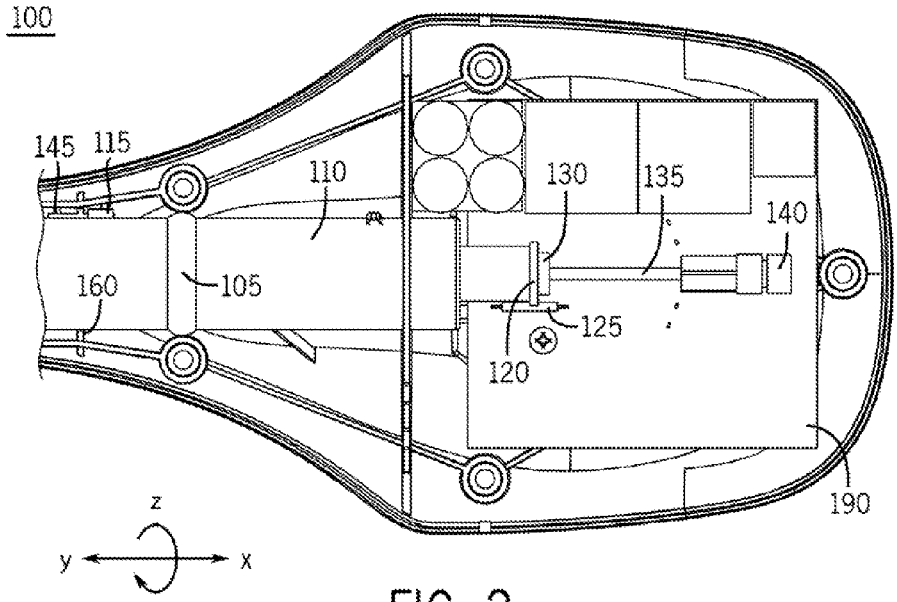
FIG. 2 is a top view of the controller head of FIG. 1.

FIG. 2 is a top view of the controller head assembly 100, again with the top cover removed. The throttle handle 110 runs along an x/y-axis and is coupled with the flexible coupling 135 with a slip joint 130. The specific operation of the slip joint 130 will be discussed further in the descriptions of FIGS. 5 and 6. However it should be noted that the slip joint 130 allows the throttle handle 110 to be moved between two positions in the x/y-axis without moving the flexible coupling 135 and the speed transducer 140 in the x/y-axis. The throttle handle 110 is also configured to be rotated around the x/y-axis in a z-radius. During this operation, the slip joint 130 engages the flexible coupling 135, thus adjusting the throttle by adjusting a potentiometer in the speed transducer 140. Rotating the throttle handle 110 in a clockwise direction about the z-radius causes the speed of the motor to increase, and rotating the throttle handle in a counter clockwise fashion about the z-radius reduces the speed of the motor.

Still referring to FIG. 2, the controller head assembly 100 also includes a ring tab 105 configured to provide the user with haptic feedback when changing the direction of the motor by selecting one of two positions in the direction of the x/y-axis. This will be discussed further with respect to FIGS. 3 and 4. A throttle stop 145 is molded from the inside surface of the controller head assembly 100, and provides a physical barrier to the throttle tab 115 such that when a user rotates the throttle handle 110 in a counter clockwise direction about the z-radius, the throttle handle 110 will physically stop rotating when the throttle tab 115 comes in contact with the throttle stop 145. This position of the throttle handle 110 corresponds with an electrically off position of the motor. Lastly, the ring magnet 120 moves in an x-direction when the throttle handle 110 is moved between a first and second position. The proximity switch 125 detects the movement of the ring magnet 120, thus controlling the direction of the motor through the circuit, which will be discussed in further detail below.

Figure 3:
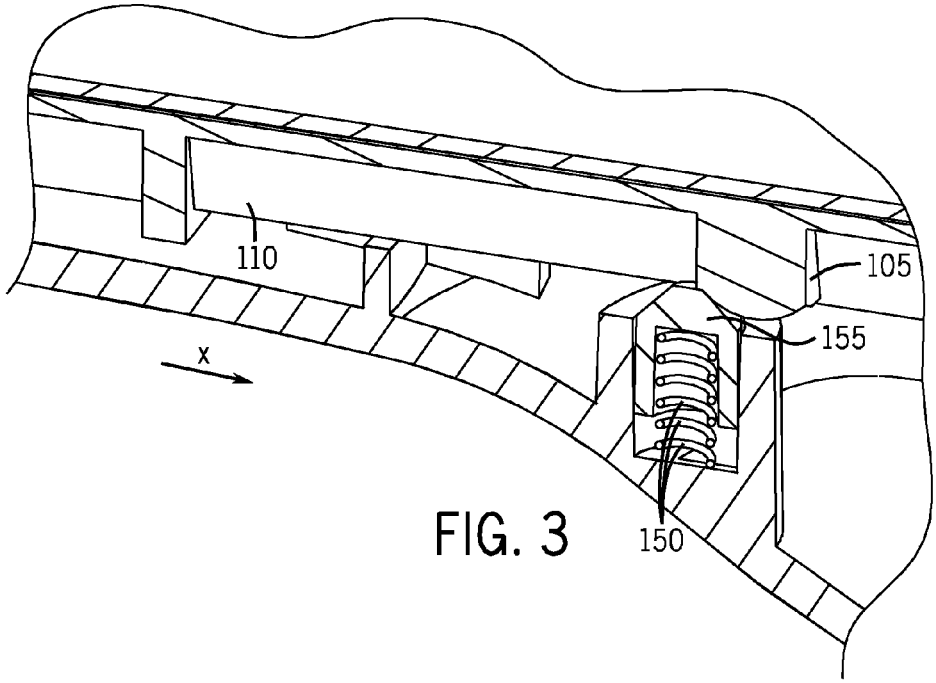
FIGS. 3 and 4 are partial cross-sectional side views of the throttle handle according to an embodiment of the present application.
Figure 4:
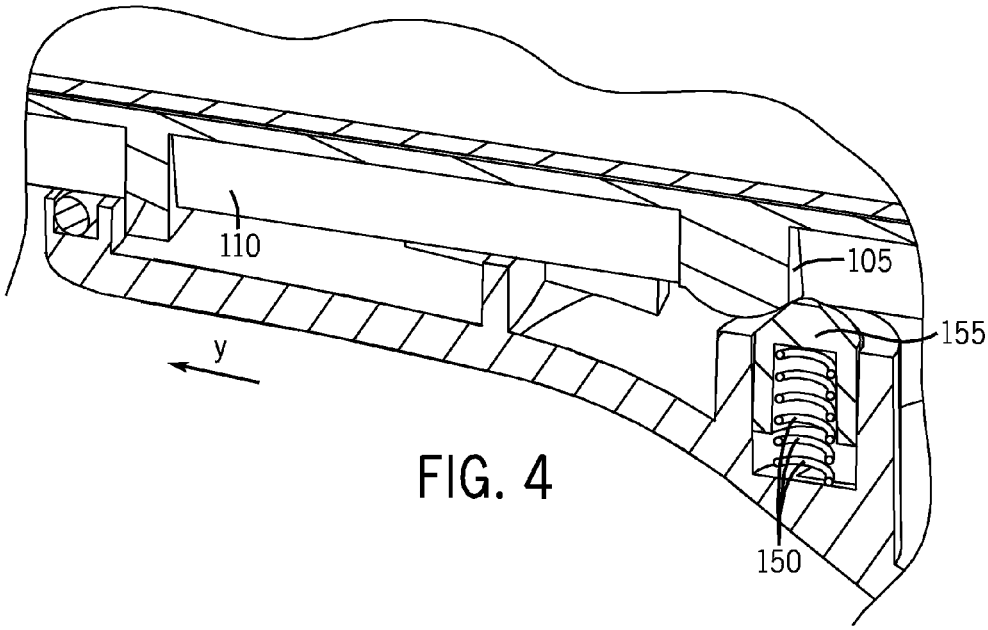
Figure 9:
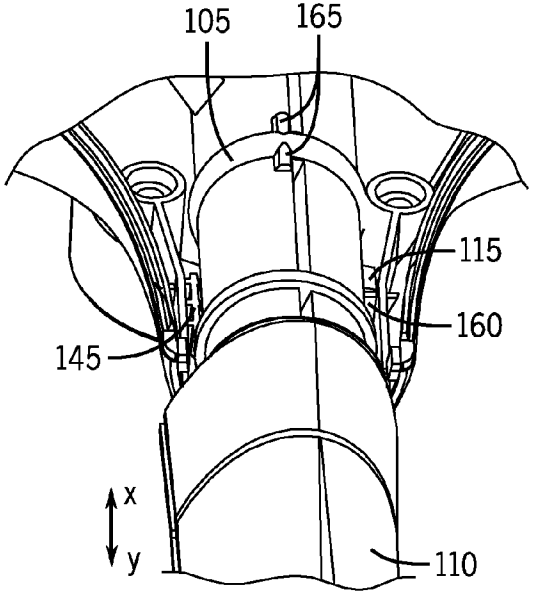
FIGS. 7-9 are partial top elevation views of a controller head assembly with top cover removed according to an embodiment of the present application.
Figure 8:
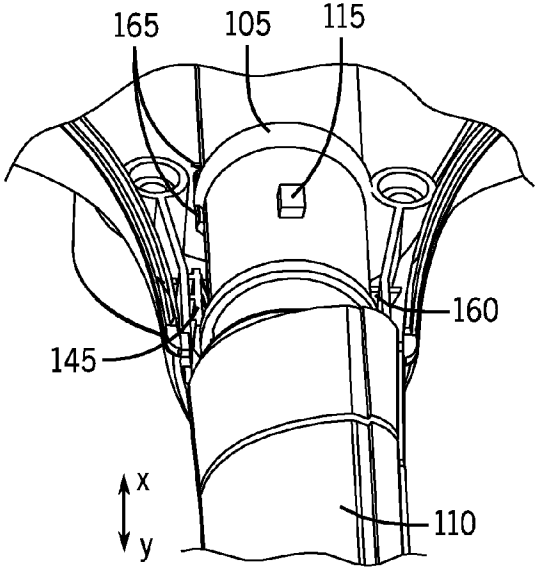

A positive throttle-off position is created with haptic feedback to a user when a throttle off tab 165 shown in FIGS. 8-9, passes over the detent button 155 shown in FIGS. 3 and 4 with rotational movement. The configuration of the throttle off tab 165 on either side of the ring tab 105 makes this haptic feedback possible in both the first and second directional position of the throttle handle 110 and ring tab 105, as will be discussed further below. The "off" position occurs during the last few degrees of counterclockwise rotation of the throttle shaft 110. The control electronics (FIGS. 10 and 11) use a voltage comparator means to sense this few degrees of CCW rotation in the speed transducer 140 in FIGS. 1 and 2 to create a motor inhibit logic and turn off the trolling motor.

A positive throttle handle 110 direction change is created with haptic feedback to the user when the ring tab 105 in FIGS. 1-4 passes over the detent button 155 shown in FIGS. 3 and 4 with axial movement (either in the x or y direction). The throttle handle 110 continues for a small amount of movement on either side of the detent button 155 to provide a positive engagement for either the forward or the reverse position and to fully activate the proximity switch 125 shown in FIGS. 1, 2, 5 and 6, which can be a magnetic reed switch but not limited to such detection. Over-travel helps to ensure that the detection engagement is not critical and will be robust against vibration and shock that is typical with a trolling motor mounted on a boat and used in water systems subject to rough weather conditions. The detent button 155 is bias against the ring tab 105 by a detent spring 150 configured between the ring tab 155 and the wall of the controller head assembly 100 as shown in FIGS. 3 and 4.

Figure 5:
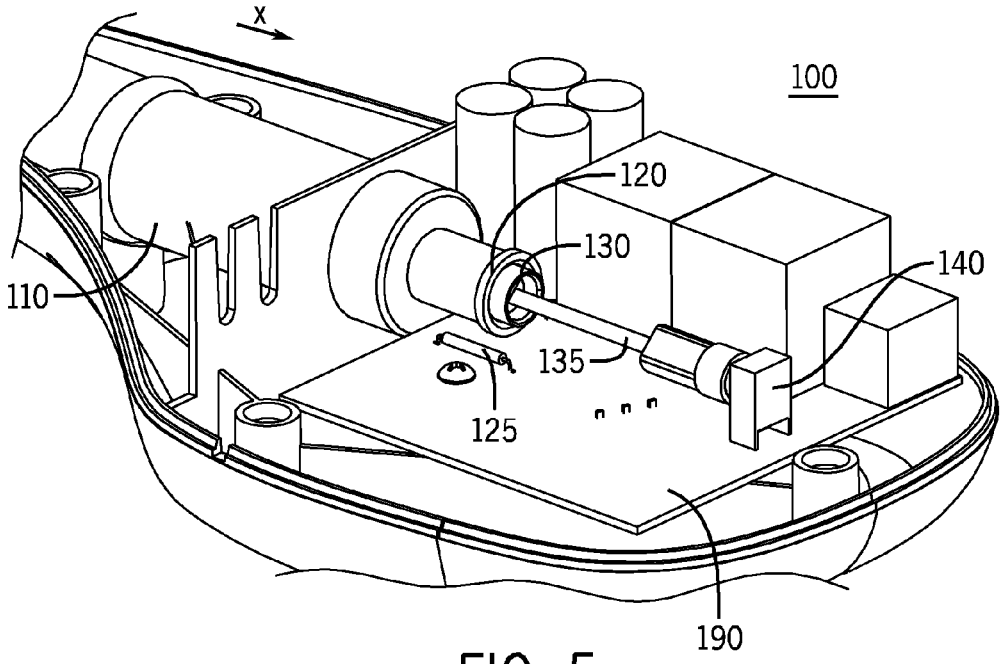
FIGS. 5 and 6 are partial elevation views illustrating a controller head assembly with top cover removed according to an embodiment of the present application.
Figure 6:
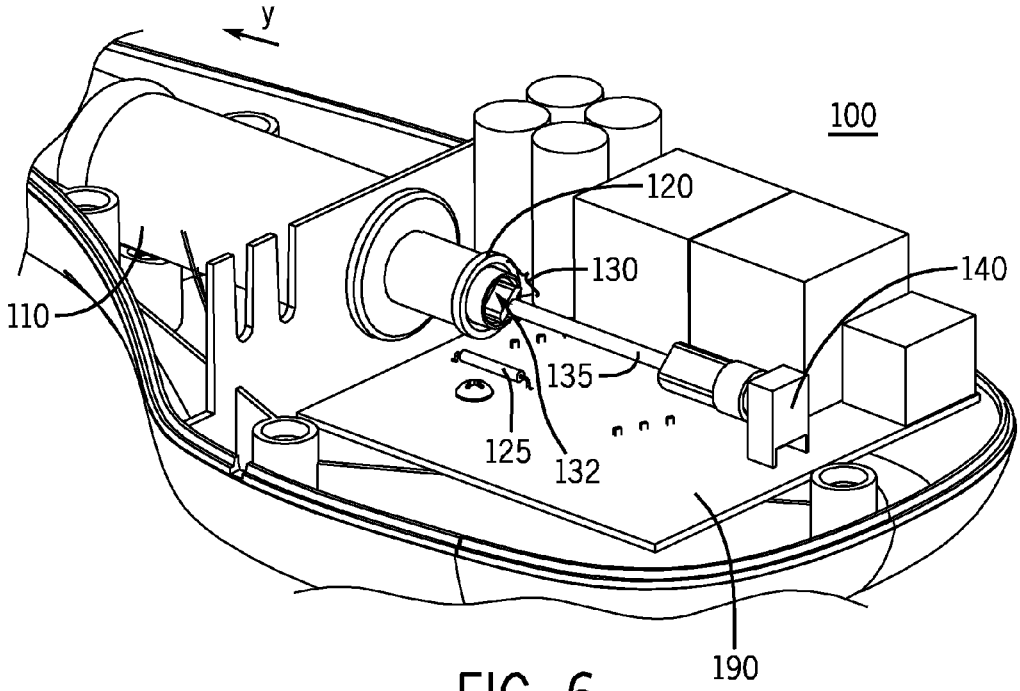

FIG. 5 illustrates the throttle handle 110 in a pushed in position, and FIG. 6 illustrates the throttle handle 110 in a pulled out position. It should be stressed that, either position represents forward or reverse boat direction depending on whether the trolling motor is mounted on the transom or the bow of the boat. The over temp, surge protection and direction control circuit 300 includes a bow/transom switch, S2 in FIG. 11, to change the logic of the reversing relays CR2 and CR3 and motor direction based on the in or out position of the throttle handle 110 to correspond to the bow or transom mounting position. For example, and referring to FIG. 5, if S2 is in the position designated for a bow mount, then pushing the throttle handle 110 in an x-direction will cause the boat to move in a forward direction. In this position, the ring magnet 120 and slip joint 130 also move in the x-direction, thus activating the proximity switch 125 with the ring magnet 120, and the slip joint 130 sliding over the flexible coupling 135. Once again, the slip joint 130 does not engage the flexible coupling when it moves in the axial direction x. Still referring to FIG. 5, one last example note should include that in a transom mount situation, moving the throttle handle 110 in an x-direction will cause the motor to operate in a reverse mode.

FIG. 6 exemplifies the controller head assembly 100 when the throttle handle 110 is moved axially in the y-direction. Here, the ring magnet 120 and slip joint 130 move with the throttle handle in the y-direction, and the slip joint again does not engage the flexible coupling 135 but instead moves freely without pulling the flexible coupling 135 with it. Here, as the slip joint 130 is moved in the y-direction, the d-piece 132 of the slip joint 130 is exposed. The d-piece 132 is the portion of the slip joint 130 that engages the flexible coupling 135 when the throttle handle 110 is moved in a radial direction when adjusting the amplitude of the throttle. This d-piece 132 incorporated within the slip joint 130 allows the throttle handle to only engage the flexible coupling 135, and thus the speed transducer 140, when the throttle handle is moved in a radial direction only. Again, when the switch S2 is configured for a bow mount, the trolling motor operates in a reverse direction when the throttle handle 110 is pulled in the y-direction. In a transom mount, the motor operates in a forward manner when the throttle handle 110 is pulled in the y-direction.

Figure 7:
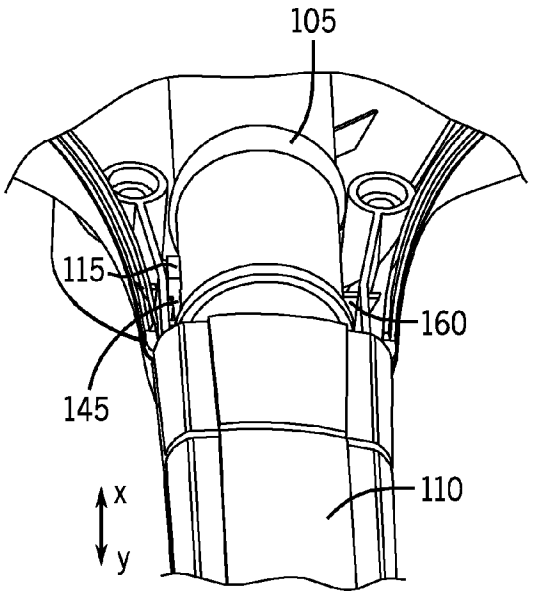

Direction reversal for a trolling motor provides for high maneuverability, but at high motor speed, this activity would be unsafe for the trolling motor operator, passengers and possibly the equipment. To protect against unintended and dangerous direction reversal at high motor speeds, the present invention provides a direction gate 160 shown in FIGS. 7-9 through which the throttle tab 115 shown in FIGS. 7-9 must pass to change direction. The throttle direction gate 160 as shown allows direction change preferable in the lower 60% of the throttle range, but blocks direction change preferably in the upper 40% of the throttle range. The throttle tab 115 shown on the x-direction side of the direction gate 160 in FIG. 7 is near the throttle stop 145 end of travel, and in FIG. 8 is approximately half way through the range where direction change is allowed approximately 50% of 60%, or 30%. In FIG. 9, the throttle tab 115 has passed the gate 160 area for direction change and is committed to the x-direction for the upper range of throttle speed. The same gating to allow direction change during the lower half of throttle speed and blocking direction change during the upper half of throttle speed applies to either the forward or reverse positions. The gate changeover point from shifting to blocking is determined by the ratio of gate open area to gate wall area and is not limited to any particular percentage of throttle travel.

Reversing a trolling motor prop rapidly and repeatedly for the purpose of changing the direction of a boat normally puts excessive and expensive demands on the electronic switching devices because the inductive motor currents surge to much higher values than the normal operating currents and the current decay is slow which stress relay contacts with current and solid state devices with avalanche voltages that must be included in the sizing and costing of the design. The present invention uses "zero voltage, zero current" switching techniques that are used in switched-mode power supplies to greatly reduce component cost that would otherwise be required to handle the switching.

Figure 10:
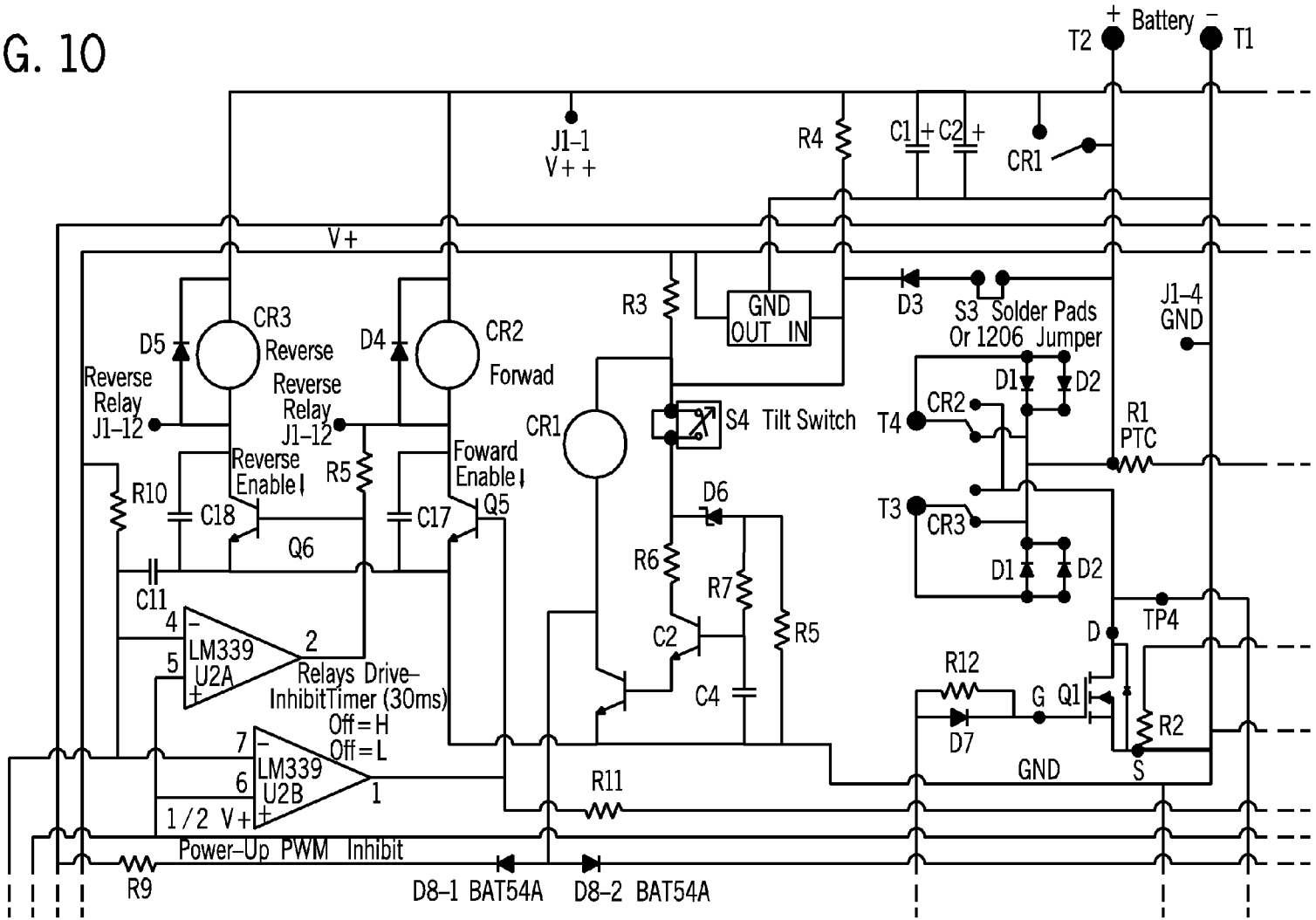
FIG. 10 is a schematic diagram illustrating a power control circuit according to an embodiment of the present application.
Figure 11:
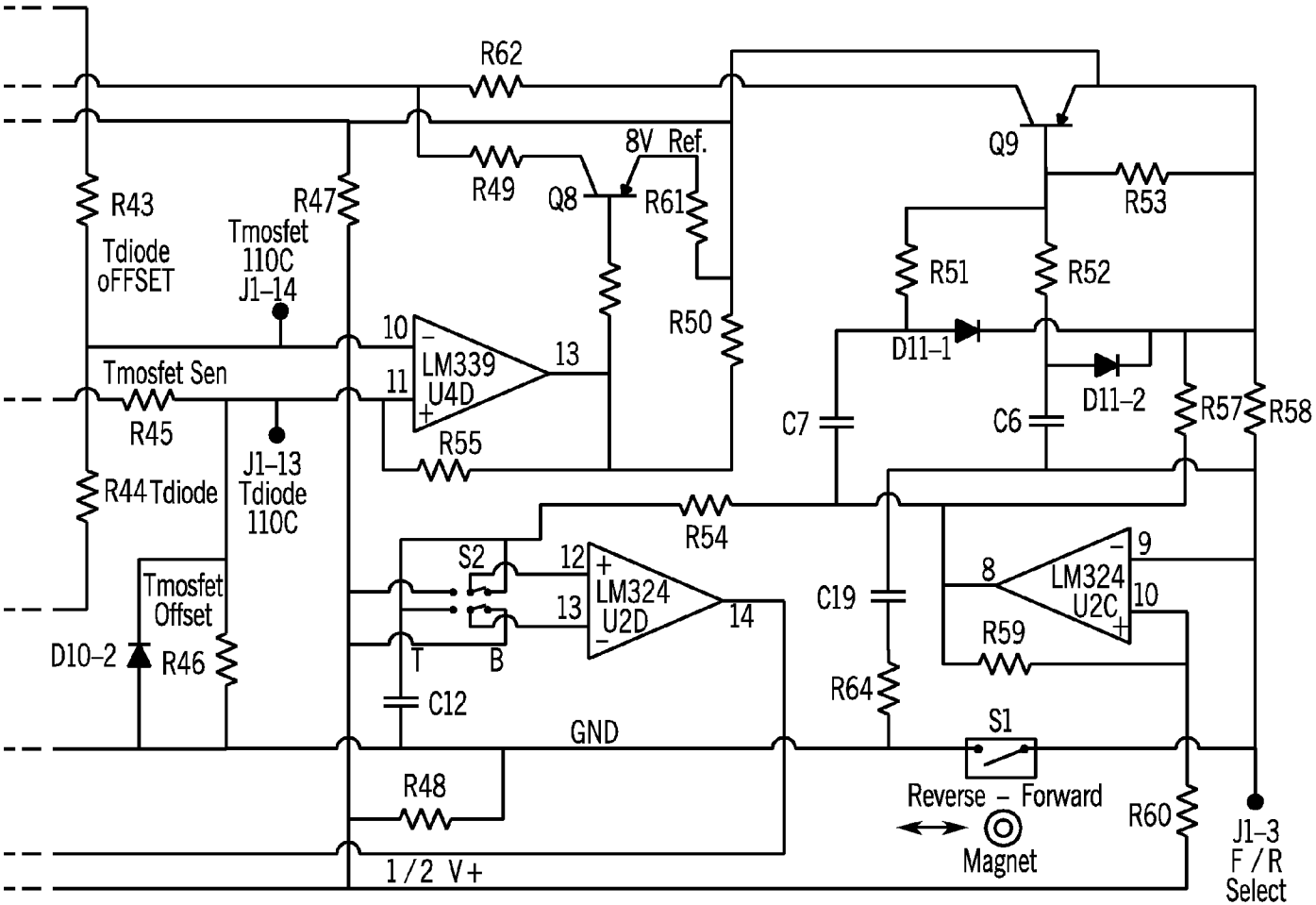
FIG. 11 is a schematic diagram illustrating an over-temperature, and surge protection and direction control circuit according to an embodiment of the present application.

Relays CR2 and CR3 in FIG. 10 are controlled by the logic of ICs U2 in FIGS. 11 and U3 in FIG. 10 such that the relays never change a present state until the motor current through the relays CR2, CR3 has diminished to zero over a time determined by the inductance of the motor after the motor current PWM has been terminated through the power MOSFET device Q1 in FIG. 10 connecting the relays to the motor in either the forward or the reverse configurations.

Referring to FIGS. 10 and 11 simultaneously, the magnet in FIG. 11 corresponds to the ring magnet 120 in FIGS. 1, 2, 5 and 6. As the magnet is moved between the two positions axially of the throttle handle 110, the proximity switch 125, here depicted in FIG. 11 as switch S1, detects the movement of the magnet and controls whether the reverse relay CR3, or forward relay CR2 is being driven.

The present invention has been described in terms of specific embodiments incorporating details to facilitate the understanding of the principals of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A direction control and throttle assembly for a trolling motor, the assembly comprising:

a throttle handle extending axially from a controller assembly, the throttle handle movable between a first and second position in an axial direction, and further movable in a rotational direction about a longitudinal axis of the throttle handle, wherein moving the throttle handle in the axially direction controls a direction of the trolling motor, and moving the throttle handle in the rotational direction controls a throttle level of the trolling motor;

a throttle tab protruding from, and fixed to rotate with, a surface of the throttle handle; and a throttle stop protruding from an inside surface of the controller assembly, wherein the throttle stop prevents further rotation of the throttle tab when the throttle handle and throttle tab are rotated in a counterclockwise direction to a throttle off position.

2. The assembly of claim 1, further comprising:

a ring tab protruding from the surface of the throttle handle and extending the circumference of the throttle handle; and a detent button protruding from the inside surface of the controller assembly, the detent button providing a bias force in a direction perpendicular to the longitudinal axis of the throttle handle with a biasing means, thus engaging a cam surface of the ring tab, wherein moving the throttle handle in an axial direction from a first position to a second position causes the ring tab to move the detent button in a direction opposite the bias force, thus providing a tactile feedback to a user.

3. The assembly of claim 2, wherein the biasing means is a detent spring.

4. The assembly of claim 1, further comprising a direction gate protruding from the inner surface of the controller assembly, wherein after the throttle tab is rotated a predetermined rotational distance from the throttle stop, the direction gate prevents the throttle handle from being moved in an axial direction by engaging the throttle tab.

5. The assembly of claim 2, further comprising a throttle off tab protruding from the surface of the throttle handle, the throttle off tab intersecting the ring tab, wherein rotating the throttle handle in the counterclockwise direction causes the throttle off tab to engage the detent button, and move the detent button to move in the direction opposite the bias force, allowing the throttle handle to continue moving to the throttle off position, thus providing the user tactile feed of the throttle off position.

6. The assembly of claim 1, further comprising a direction sensor configured on an end of the throttle handle proximate to a controller board of the trolling motor, wherein the direction sensor detects an axial position of the throttle handle and effectuates a corresponding operating direction of the trolling motor.

7. The assembly of claim 6, wherein the direction sensor includes a 360 degree annular emitter physically coupled with the throttle handle and a proximity sensor switch fixed to the controller board, wherein the proximity sensor switch detects a position of the annular emitter and switches the direction of the trolling motor.

8. The assembly of claim 1, further comprising:

a slip joint coupled with the end of the throttle handle proximate to the controller board; and a flexible coupling coupled with the slip joint and further coupled to a speed transducer, wherein the slip joint includes a d-piece that engages the flexible coupling causing the flexible coupling to rotate and adjust the speed transducer when the throttle handle is moved in a rotational direction, and further wherein the d-piece does not engage the flexible coupling when the throttle handle moves in the axial direction.

9. A direction control and throttle assembly for a trolling motor, the assembly comprising:

a throttle handle extending from a controller assembly, the throttle handle movable between a first and second position in an axial direction, and further movable in a rotational direction about a longitudinal axis of the throttle handle, wherein moving the throttle handle in the axially direction controls a direction of the trolling motor, and moving the throttle handle in the rotational direction controls a throttle level of the trolling motor;

a direction sensor configured on an end of the throttle handle proximate to a controller board of the trolling motor, wherein the direction sensor detects an axial position of the throttle handle and effectuates a corresponding operating direction of the trolling motor wherein the direction sensor includes a 360 degree annular emitter physically coupled with the throttle handle and a proximity sensor switch fixed to the controller board, wherein the proximity sensor switch detects a position of the annular emitter and switches the direction of the trolling motor; and a slip joint coupled with the end of the throttle handle proximate to the controller board; and a flexible coupling extending axially from the throttle handle and coupling the slip joint and a speed transducer fixed to the controller board, wherein the flexible coupling is coupled to the slip joint with a d-piece, wherein the d-piece engages the flexible coupling when the throttle handle is moved in a rotational direction causing the flexible coupling to rotate and adjust the speed transducer, and further wherein the d-piece does not engage the flexible coupling when the throttle handle moves in the axial direction.

10. The assembly of claim 9, further comprising a throttle tab protruding from a surface of the throttle handle; and a throttle stop protruding from an inside surface of the controller assembly, the throttle stop configured to engage the throttle tab when the throttle handle is rotated in a counterclockwise direction to a throttle off position.

11. The assembly of claim 9, further comprising:

a ring tab protruding from the surface of the throttle handle and extending the circumference of the throttle handle; and a detent button protruding from the inside surface of the controller assembly, the detent button providing a bias force in a direction perpendicular to the longitudinal axis of the throttle handle with a biasing means thus engaging a cam surface of the ring tab, wherein moving the throttle handle in an axial direction from a first position to a second position causes the ring tab to move the detent button in a direction opposite the bias force.

12. The assembly of claim 11, wherein the biasing means is a detent spring.

13. The assembly of claim 10, further comprising a direction gate protruding from the inner surface of the controller assembly, wherein after a predetermined rotational distance from the throttle stop, the direction gate prevents the throttle handle from being moved in an axial direction by engaging the throttle tab.

14. The assembly of claim 11, further comprising a throttle off tab protruding from the surface of the throttle handle, the throttle off tab intersecting the ring tab, wherein rotating the throttle handle in the counterclockwise direction causes the throttle off tab to engage the detent button, and move the detent button to move in the direction opposite the bias force, allowing the throttle handle to continue moving to the throttle off position.

15. The assembly of claim 9, further comprising a zero-current circuit, wherein a direction of the trolling motor is reversed, and further wherein the zero-current switching circuit allows a set of motor currents to diminish to zero before reversing a motor voltage.

16. The assembly of claim 9, wherein a logic switch sets a throttle shaft axial direction logic according to whether the trolling motor is mounted on a transom or a bow of a boat.

17. A direction control and throttle assembly for a trolling motor, the assembly comprising:

a throttle handle extending horizontally from a controller assembly, the throttle handle movable between a first and second position in an axial direction, and further movable in a rotational direction about a longitudinal axis of the throttle handle, wherein moving the throttle handle in the axially direction controls a direction of the trolling motor, and moving the throttle handle in the rotational direction controls a throttle level of the trolling motor;

a throttle tab protruding from, and fixed to rotate with, a surface of the throttle handle; and a throttle stop protruding from an inside surface of the controller assembly, wherein the throttle stop prevents further rotation of the throttle tab when the throttle handle and throttle tab are rotated in a counterclockwise direction to a throttle off position; and a direction gate protruding from the inner surface of the controller assembly, wherein after the throttle tab is rotated a predetermined rotational distance from the throttle stop, the direction gate prevents the throttle handle from being moved in an axial direction by engaging the throttle tab.

* * * * *